US007431284B2

(12) United States Patent
Gaarder et al.

(10) Patent No.: US 7,431,284 B2
(45) Date of Patent: Oct. 7, 2008

(54) SHEET TRANSFER APPARATUS

(75) Inventors: Glenn Gaarder, Ramona, CA (US); Mark Randolph Marrs, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 601 days.

(21) Appl. No.: 10/775,411

(22) Filed: Feb. 10, 2004

(65) Prior Publication Data

US 2004/0155397 A1 Aug. 12, 2004

Related U.S. Application Data

(63) Continuation of application No. 10/633,126, filed on Aug. 1, 2003, now Pat. No. 6,969,058, which is a continuation of application No. 09/880,407, filed on Jun. 13, 2001, now Pat. No. 6,666,446.

(51) Int. Cl.
*B65H 3/06* (2006.01)

(52) U.S. Cl. ..... 271/114

(58) Field of Classification Search ..... 271/117, 271/118, 114; 74/352, 69, 325, 337
See application file for complete search history.

(56) References Cited

U.S. PATENT DOCUMENTS

| | | | | | |
|---|---|---|---|---|---|
| 4,589,650 | A * | 5/1986 | Miyoshi | 271/242 |
| 5,222,723 | A * | 6/1993 | Ijuin | 271/10.11 |
| 5,419,543 | A * | 5/1995 | Nakamura et al. | 271/9.01 |
| 5,421,569 | A * | 6/1995 | Davidson | 271/109 |
| 5,709,380 | A * | 1/1998 | Petocchi et al. | 271/125 |
| 5,742,318 | A * | 4/1998 | Miyauchi et al. | 347/134 |
| 5,769,410 | A * | 6/1998 | Davidson et al. | 271/109 |
| 5,882,002 | A * | 3/1999 | Kamei et al. | 271/118 |
| 5,921,539 | A * | 7/1999 | Westcott et al. | 271/10.03 |
| 6,024,356 | A * | 2/2000 | Tanaka et al. | 280/11.214 |
| 6,168,147 | B1 * | 1/2001 | Nose et al. | 271/10.13 |
| 6,581,924 | B2 * | 6/2003 | Gaarder et al. | 271/114 |
| 6,666,446 | B2 * | 12/2003 | Gaarder et al. | 271/10.04 |
| 6,874,776 | B2 * | 4/2005 | Gaarder et al. | 271/10.04 |
| 2002/0179222 | A1 * | 12/2002 | Velasquez et al. | 156/64 |
| 2004/0021264 | A1 * | 2/2004 | Gaader et al. | 271/117 |

FOREIGN PATENT DOCUMENTS

| | | | |
|---|---|---|---|
| DE | 3334522 | * | 3/1984 |
| EP | 0314167 | * | 5/1989 |
| JP | 59108636 | * | 6/1984 |

* cited by examiner

*Primary Examiner*—Patrick Mackey
*Assistant Examiner*—Thomas A Morrison

(57) ABSTRACT

A sheet transfer apparatus includes a first roller, a second roller and a power train. The first roller is configured to be rotatably driven at a first surface speed. The second roller is spaced from the first roller such that the first roller and the second roller are configured to simultaneously engage a media sheet. The second roller is configured to be driven at a second surface speed greater than the first surface speed. The power train delivers power to the first roller to rotatably drive the first roller. The power train includes a first gear coupled to the first roller, a second gear and a third gear. The third gear is movable between a first position in which the third gear is in power transmitting engagement with both the first gear and the second gear and a second position in which the third gear is out of power transmitting engagement with the second gear.

30 Claims, 18 Drawing Sheets

111
114
82
116
118
112
117
119
81
115
121
113

50
76
70
72
98
102
110
104
82
84
74
64
4A
4A
56
54
68
58
92
90
80
66
52
62
69
111
120
116
113
112
117
81
80

SHEET TRANSFER APPARATUS

CROSS REFERENCE TO RELATED APPLICATIONS

The present continuing application claims priority under 35 U.S.C. § 120 from U.S. patent application Ser. No. 10/633,126 filed on Aug. 1, 2003 now U.S. Pat. No. 6,969,058 by Glenn Gaarder et al. and entitled REPLACEABLE ROLLER BOGIE FOR DOCUMENT FEEDING APPARATUS, which is a continuation of U.S. patent application Ser. No. 09/880,407, filed on Jun. 13, 2001 now U.S. Pat. No. 6,666,446, the full disclosures of which are hereby incorporated by reference.

BACKGROUND OF THE INVENTION

The present invention relates generally to the art of document processing equipment such as scanners, printers, facsimile machines and combination devices which use single sheet feeders to pick single sheets of media to be processed from a stack thereof. Such equipment includes sheet moving rollers, belts or wheels and, in particular, the sheet feeders with which the present invention is concerned employ both a pre-feed roller and a separation roller spaced downstream from the pre-feed roller. A stack stop is positioned to be moved into and out of the path of sheet movement between the rollers. Worn or otherwise damaged rollers in such equipment occasionally require replacement necessitating a service call and attendant expense. It is accordingly desirable to provide a modular single sheet feeder which can be easily assembled at the factory and which also has easily replaceable rollers which can be serviced by the user without the necessity to involve a skilled service technician.

BRIEF DESCRIPTION OF THE DRAWINGS

FIG. 8B is a cross sectional elevation of the bogie like. FIG. 8A showing the engaged position of the pre-feed roller clutching gear.

DETAILED DESCRIPTION OF THE EXAMPLE EMBODIMENT

Figure 1:
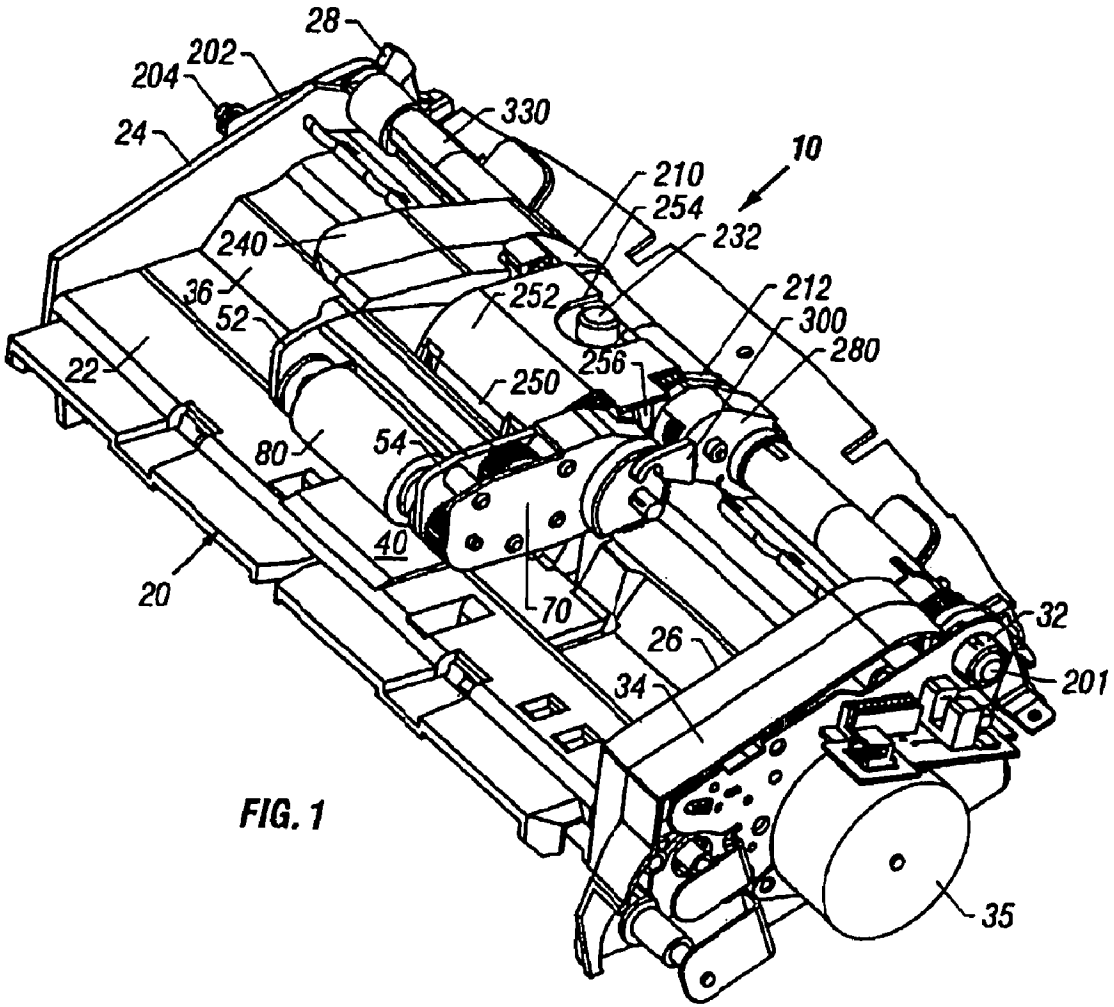
FIG. 1 is a perspective view of a single sheet feeder module which includes a media input tray shown partly in section, a modular roller support assembly, and a removable roller bogie.
Figure 2:
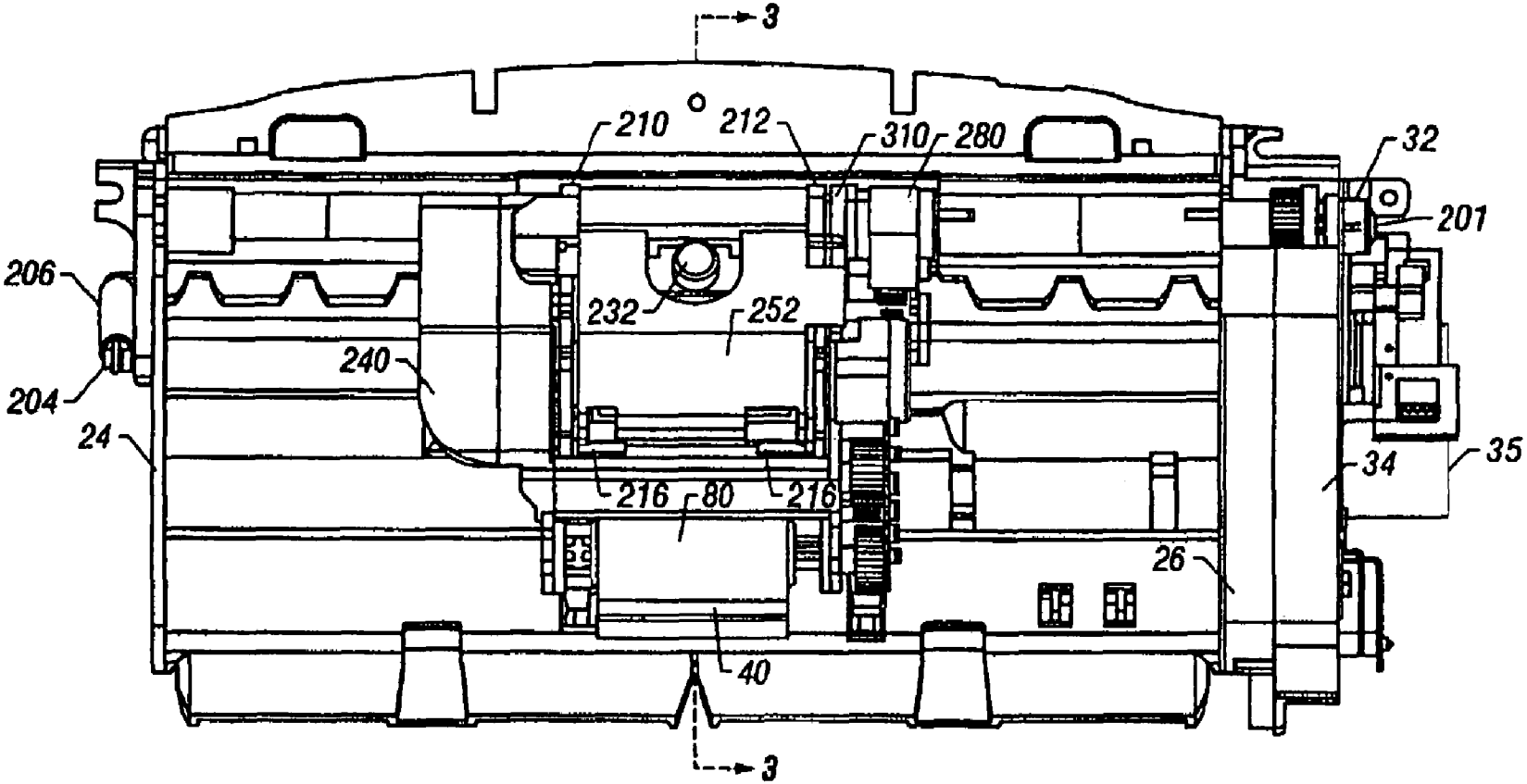
FIG. 2 is a top plan view of the sheet feeder module.
Figure 3:
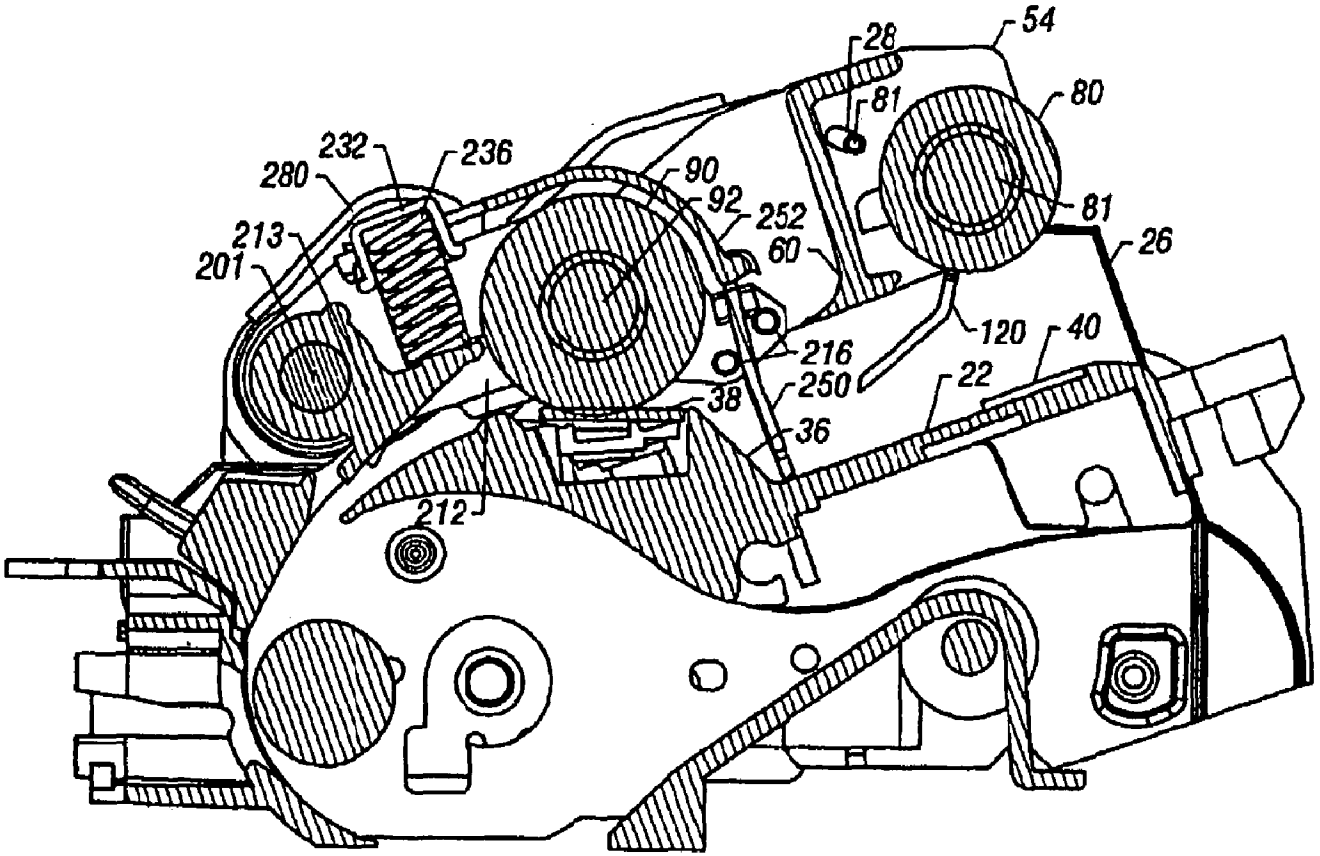
FIG. 3 is a cross sectional elevation taken at line 3-3 on FIG. 2.

The modular sheet feeder 10 seen in the perspective view in FIG. 1 is a separate unit of a document processing apparatus which includes a document processing module (not shown) such as a printer, scanner, facsimile machine or copier or combination of any of the foregoing. The sheet feeder module 10 is affixed to the document processing module (not shown) for feeding individual sheets from the top of a stack thereof to sheet transporting mechanism in the document processing module.

The sheet feeder module 10 is comprised of an input tray, not shown, that attaches to input frame 20 having a stack support surface 22 and spaced sides 24, 26 in the form of upstanding walls which define a sheet transport path for moving individual sheets from the top of a stack supported on a stack support surface 22 from left to right as seen in FIG. 1. The side wall 24 includes a shaft mounting cradle having a non-circular gate 28 and an integrally formed spring mounting post 30 for purposes which will be described. The other side wall 26 is provided with a bushing aperture 32 located in a motor support plate 34 attached by suitable fasteners to the wall 26. A reversible electric step motor 35 is supported on the motor support plate 34 which, with the wall 26, defines a housing for the motor and motor output gear (not shown).

The input frame 20, which may be of molded plastic as is conventional, includes a stack retard wall 36 which is angled upwardly and away from the stack support surface 22 and with a retard pad 38 positioned for engagement with the arcuate surface of a single sheet separation roller 90 and with a pad 40, preferably of cork, for engagement with a sheet pre-feed roller 80. As used herein, the term 'roller' includes single and multiple rollers and spaced or adjacent coaxially mounted wheels and equivalents for moving single sheets of media such as moveable belts trained around spaced rollers.

A replaceable roller bogie comprising a frame 50 formed of spaced side members or plates 52, 54 joined by a cross piece 60 support a pre-feed roller 80 and a single sheet separation roller 90 downstream of the pre-feed roller 80. Side plate 54 has an integrally formed tail or lever arm 56 which extends generally parallel to a line connecting the centers of rotation of the pre-feed roller 80 and single sheet separation roller 90. The side plates 52, 54 include bearing apertures 62, 64 for a pre-feed roller support shaft and bearing apertures 66, 68 for a separation roller support axle 92. A gear retainer plate 70 is mounted on and spaced from side plate 54 by spacing posts 74 and fasteners 76. A pre-feed roller clutch gear shaft slot 58 in side plate 54 aligns with a pre-feed roller clutch gear shaft mounting slot 72 in the gear retainer 70.

The sheet pre-feed roller 80 is supported on a shaft 81 whose ends are received in the apertures 62, 64 in the side plates 52, 54, respectively. As is conventional, the pre-feed roller has an elastomeric surface or a surface texture suitable for engaging the top surface of a sheet to be removed from the stack. Similarly, the single sheet separation roller 90 is supported on an axle 92 the ends of which are received in the bearing apertures 66, 68 in the side plates 52, 54. In sheet transporting position, the separation roller 90 forms a sheet separation nip with a surface of the retard pad 38. The separation roller axle 92 has spaced support bearings 94, 96 thereon for a purpose to be described and a separation roller drive gear 98 is also mounted on the axle 92 for driving the separation roller 90. A plurality of intermediate gears 102, 104 may be provided to transmit power from the rotating separation roller 90 to rotate the pre-feed roller 80 through a pre-feed roller clutch gear 110 which preferably has elastomeric teeth permanently engaged with the pre-feed roller drive gear 82. The clutch gear 110 is supported on a shaft, the ends of which are received in the slots 58, 72 which are preferably arcuate and are centered on the axis of rotation of gear 104 which is continually engaged with the clutch gear 110.

Figures 4, 4A:
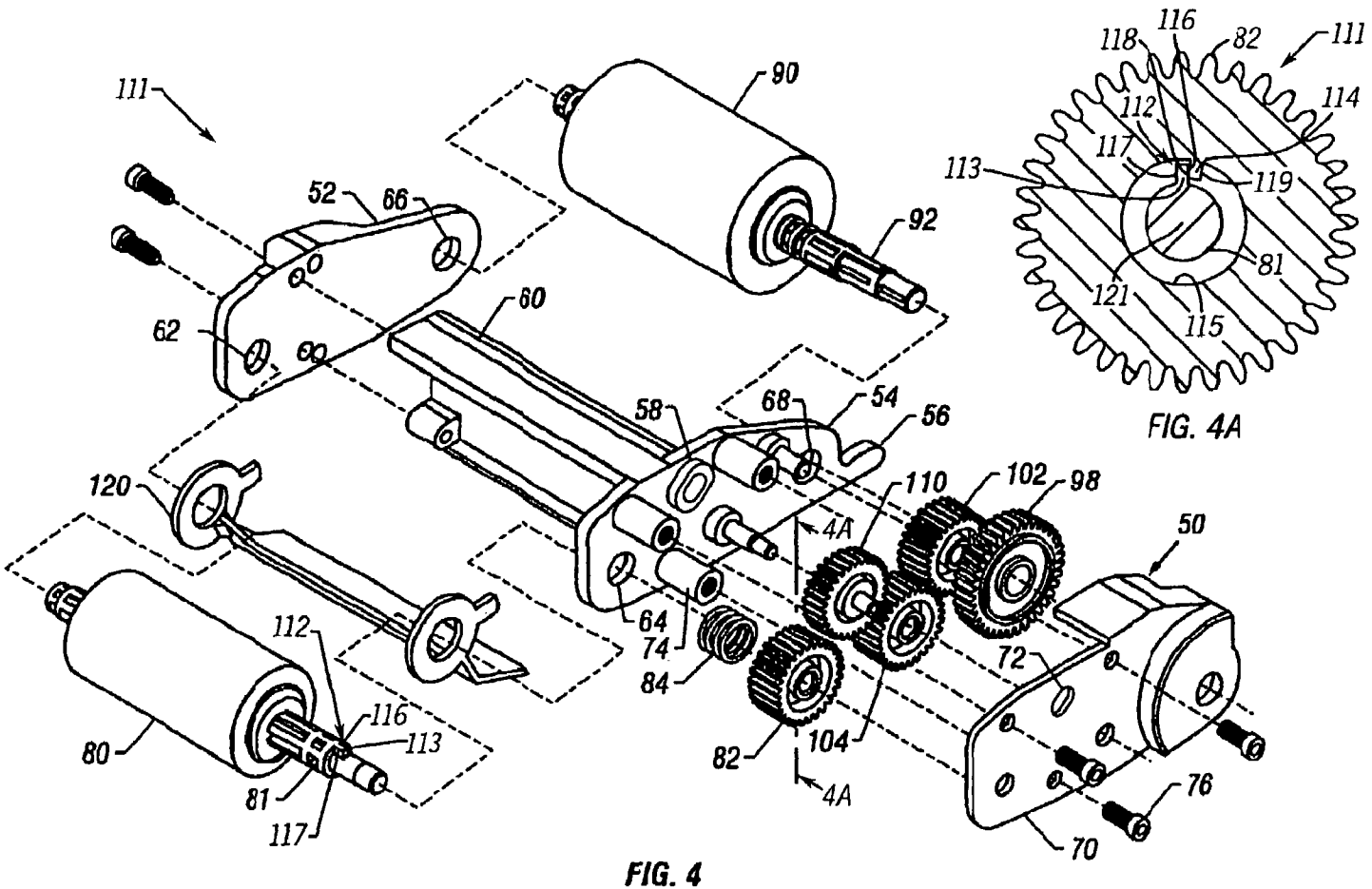
FIG. 4 is an exploded perspective view of the bogie.
FIG. 4A is a sectional view of the sheet feeder module of FIG. 4 taken along line 4A-4A.
Figure 5:
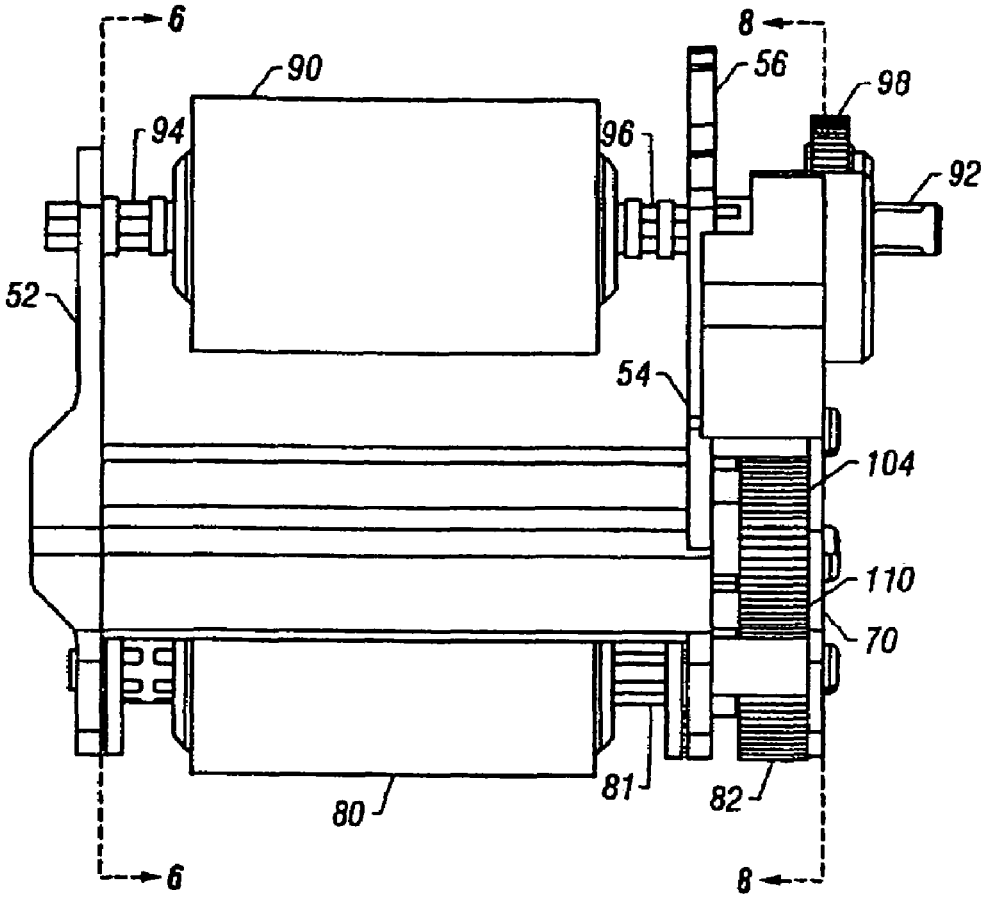
FIG. 5 is a plan view of the bogie.

As best shown by FIGS. 4 and 4A, the roller bogie 111 additionally includes a dwell mechanism 112 generally situated between pre-feed roller 80 and gear 82. Dwell mechanism 112 enables dwell to be built up as pre-feed roller 80 is being overdriven when pre-feed roller 80 and separation roller 90 simultaneously engage a media sheet. Dwell mechanism 112 generally includes roller finger 113 and gear finger 114. Roller finger 113 generally comprises a projection extending from shaft 81 of pre-feed roller 80 into an inner bore 115 within gear 82. Finger 113 includes generally opposite surfaces 116 and 117.

Gear finger 114 comprises a projection extending from gear 82 into bore 115 so as to overlap finger 113 in a radial direction from an axial center line of shaft 81. Finger 114 includes generally opposite surfaces 118 and 119.

Gears 98, 102, 104, 110 and 82 serve as a power train between separation roller 90 and pre-feed roller 80. The supply of torque to gear 98 results in separation roller 90 being driven at a greater surface speed as compared to pre-feed roller 80. In operation, torque applied to gear 98 is transmitted to gear 82 through gears 102, 104 and 110. Surface 118 of finger 114 engages surface 116 of finger 113 to further transmit torque to shaft 81 and pre-feed roller 80 to rotatably drive pre-feed roller 80. As a result, a media sheet engaged by pre-feed roller 80 is driven into engagement with separation roller 90 such that media sheet is simultaneously engaged by both separation roller 90 and pre-feed roller 80. Because separation roller 90 is rotatably driven at a greater surface speed as compared to pre-feed roller 80, separation roller 90 pulls the media sheet at a speed greater than the surface speed at which pre-feed roller 80 is normally driven by gear 82. This results in pre-feed roller 80 being overdriven and shaft 81 rotating at a faster speed about axis 121 as compared to gear 82. Consequently, surface 116 is disengaged from surface 118 as finger 113 is rotated away from finger 114 to create dwell.

A maximum dwell is attained when surface 117 engages surface 119. When such a maximum dwell is attained, surface 117 engages surface 119 to rotatably drive gear 82 about axis 121 in a counterclockwise direction as seen in FIG. 4A. This results in gear 82 rotatably driving gear 110 at a faster rate as compared to gear 104 such that gear 110 is moved along slots 58 and 72 out of engagement with gear 82. Slot 58 permits movement of gear 110 out of engagement with gear 82 to cessate transmission of power to gear 82. Clutch gear 110 remains disengaged from gear 82 until the media sheet becomes disengaged from pre-feed roller 80.

Once pre-feed roller 80 and separation roller 90 are no longer simultaneously engaging the same media sheet, clutch gear 110 returns into engagement with gears 104 and 82 under the force of gravity. At this point in time, torque from gear 104 is transmitted to gear 82 through clutch gear 110. As a result, gear 82 is rotatably driven about axis 121 without transmitting torque to pre-feed roller 80. Once finger 114 has completely rotated about axis 121 such that the dwell has been consumed and such that surface 118 engages surface 116, torque is again transmitted to pre-feed roller 80 to rotatably drive pre-feed roller 80 and to feed a new media sheet towards separation roller 90.

Figure 6:
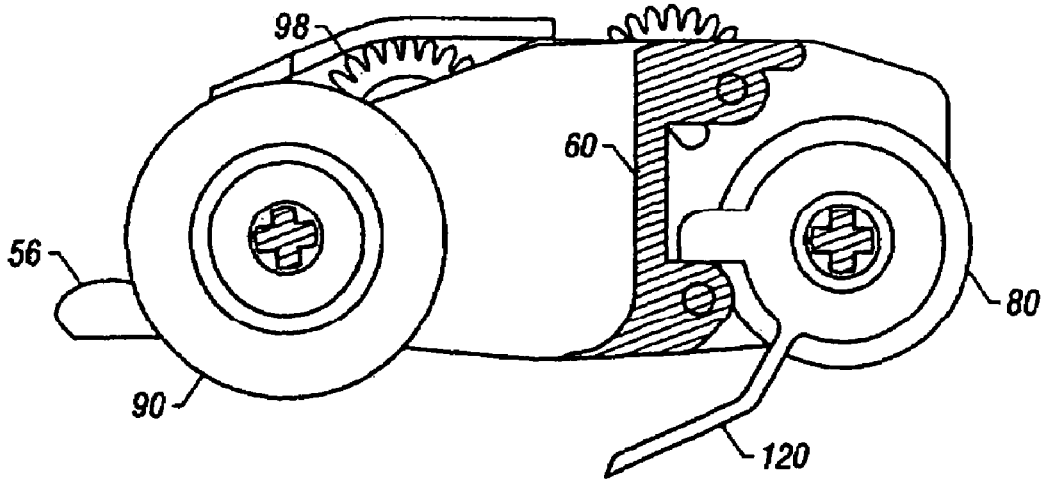
FIG. 6 is a cross sectional elevation of the bogie taken at line 6-6 on FIG. 5 showing a stack damper on the bogie.
Figure 7:
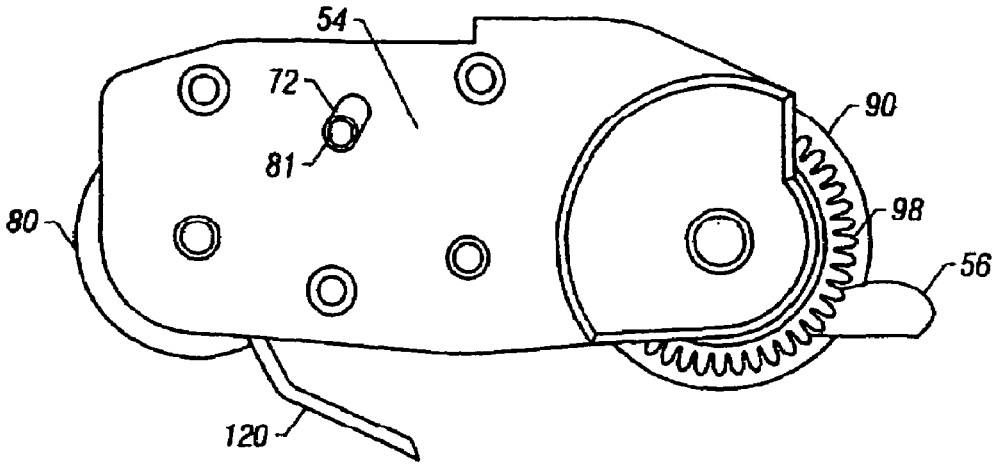
FIG. 7 is a right side elevation of the bogie.
Figure 8A:
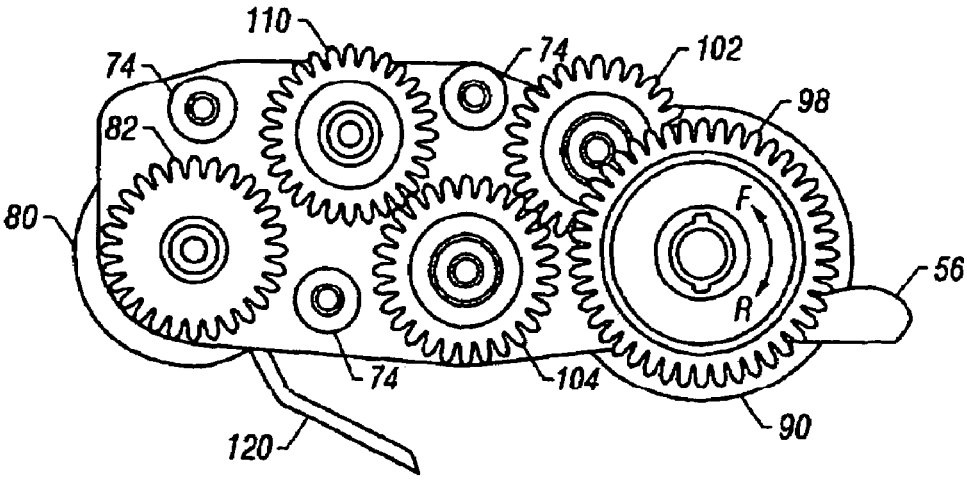
FIG. 8A is a cross sectional elevation of the bogie taken at line 8-8 on FIG. 5 showing the gear cluster and disengaged pre-feed roller clutching gear.
Figure 8B:
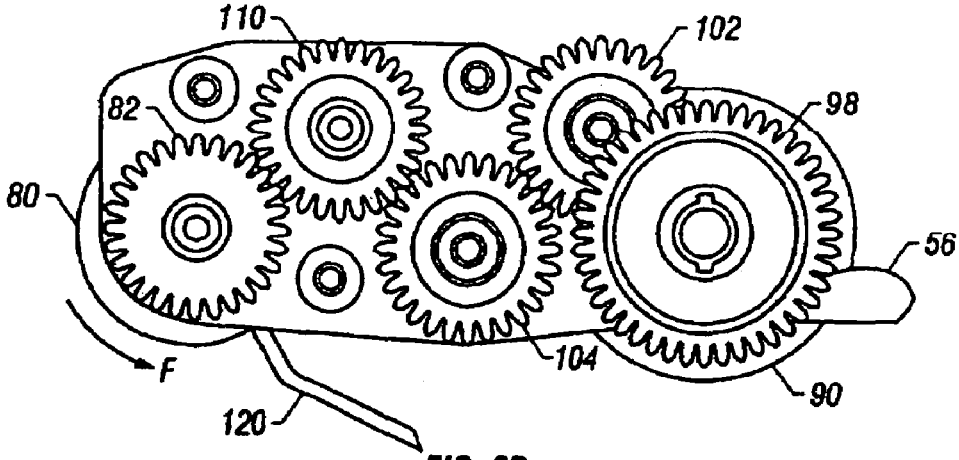
Figure 9:
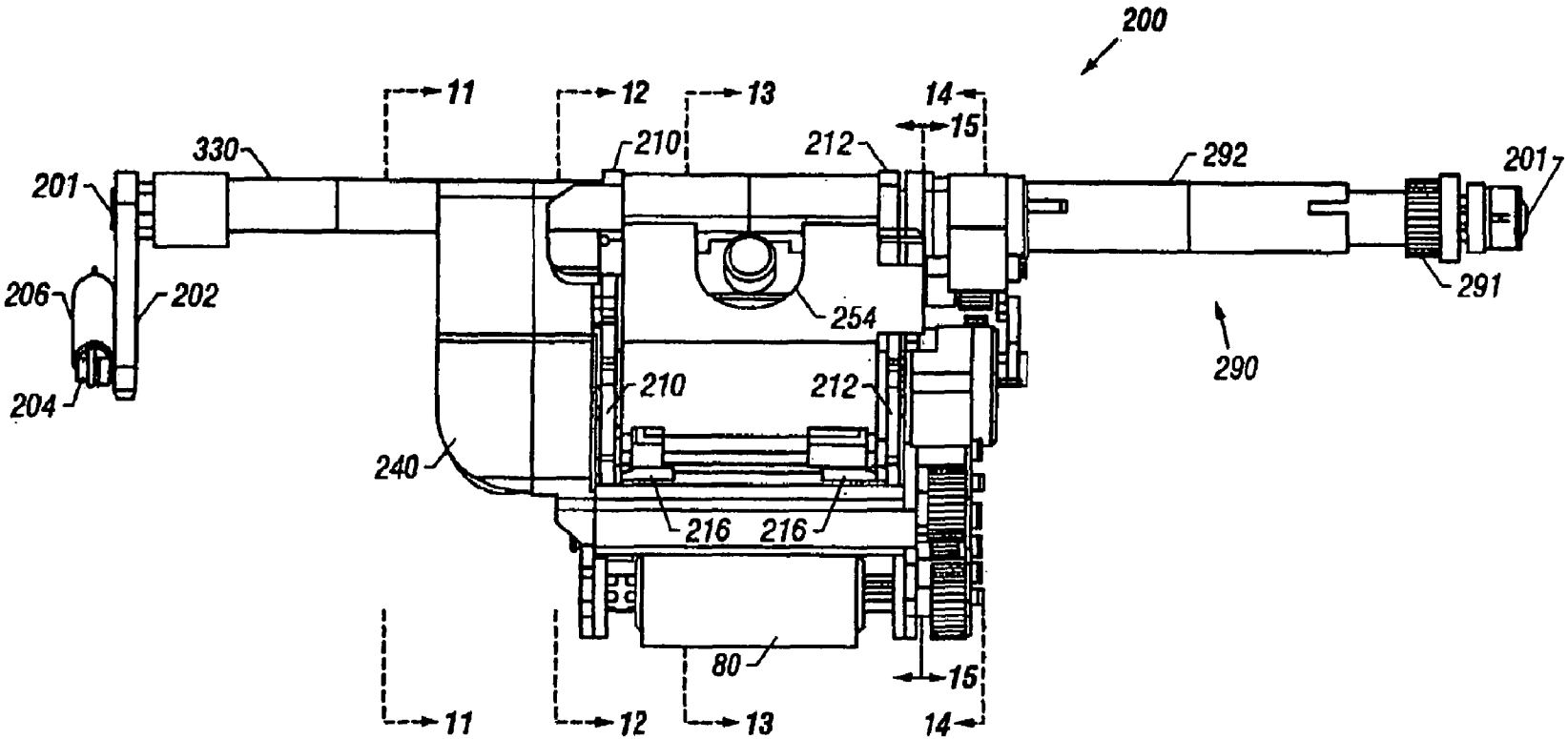
FIG. 9 is a plan view of the modular roller support assembly and bogie removed from the sheet feeder module.

A stack damper 120 is freely rotatable on the pre-feed roller support shaft 81, the stack damper having a surface which extends in the downstream direction of sheet movement from the pre-feed roller 80 parallel to the surface of a stack of media sheets on the support surface 22. The stack damper 120 is heavy enough to prevent buckling of thin sheets between the pre-feed roller 80 and the separation roller 90 and is free to pivot upwardly by sheet contact, particularly with heavy sheets, until it engages a stop surface on the frame such as the cross piece 60 as seen in FIG. 6. The roller frame 50 thus supports the pre-feed roller 80, single sheet separation roller 90, gears and stack damper 120, if provided, which together comprise a replaceable bogie which is supported by a modular roller support and drive assembly 200 to be described.

The modular roller support and drive assembly 200 is comprised of a shaft 201 received in axially aligned shaft supports in the spaced side walls 24, 26 of the input tray 20. One of the shaft supports comprises the bushing aperture 32 into which one end of the shaft is inserted as the other end of the shaft, having a part non-circular configuration, is rotated to the appropriate position to be dropped into the other support through the non-circular shaft mounting slot 28. The shaft also has a transversely extending spring arm 202 non-rotatably affixed to the shaft, the arm 202 having a spring retainer or boss 204 protruding therefrom. A biasing member, preferably a tension spring 206, is connected between the spring retainer 30 on the side of the input tray and the boss 204 on the spring arm 202. The spring 206 passes over the center axis of the shaft 201 as the spring is tensioned.

The replaceable bogie is supported between a pair of spaced bogie support load arms 210, 212 non-rotatably affixed to the shaft 201. The bogie support arms preferably also include spaced axially aligned support hubs 214 for supporting a stack stop link 252. The load arms 210, 212 also preferably have spaced transversely extending stack stop guides 216 thereon and are provided with aligned bogie support apertures or slots 218, 220 in which the spaced bearings 94, 96 on the separation roller axle 92 are received to support the removable bogie on the modular roller support and drive assembly 200. A bogie retention latch 230 having a release button 232 and spaced latch hooks 234 is pivotally mounted between the bogie support arms 210, 212, the latch being biased to closed position by a bogie latch spring 236 seated between the bogie latch button and a transverse brace which extends between and is connected to the load arms 210, 212. The latch hooks 234 engage the bogie support arms when the latch is closed to avoid clamping of the latch hooks onto the bearings 94, 96 of the separation roller axle 92.

A bogie lifting handle 240 is preferably also provided, the handle 240 being non-rotatably affixed to the support shaft 201. The lifting handle is biased to a downward position by a spring 242 engaged with a seat on the load arm 210 so that lifting of the handle 240 first compresses the spring 242 before lifting the load arms 210, 212 and attached bogie. The compression spring 242 also biases the bogie downwardly through contact of the end of the handle 240 with the upper surface of the bogie frame providing the force on the pre-feed roller 80 in the media feed position and urging the frame tail or lever arm 56 upwardly against a cam surface of a follower 260 to be described when the follower has lifted the bogie to the up positions. The lifting handle 240 and tension spring 206 are designed with over center geometry so that the spring 206 will bias the bogie downwardly for sheet feeding and will hold the handle and bogie in the lifted position to facilitate removal of jammed sheets and inspection of the paper path.

A stack stop 250 comprising a substantially rectangular plate which is vertically guided between the stack stop guides 216 is pivotally connected to and extends downwardly from a stack stop link 252 between the pre-feed roller 80 and single sheet separation roller 90. The stack stop link 252 is pivotally attached to and supported between the spaced load arms 210, 212 such that the stack stop 250 is movable into and out of the path of movement of a media sheet downstream of the pre-feed roller 80 and upstream of the single sheet separation roller 90. A downwardly extending leg 256 is integrally formed on a stack stop link for engagement with a follower 260 to lift and lower the stack stop 250.

As seen best in FIG. 16, the follower 260 having a pivot aperture 262 therein is pivotally mounted on a follower support post 222 received in the aperture 262, the post extending outwardly from the load arm 212 in a direction parallel to the axis of the support shaft 201. The follower 260 has a point 264, a cylindrical first cam surface 266 (FIG. 16A) which engages the bogie tail lever arm 56 as the follower 260 pivots on its support post to partly raise the bogie and pre-feed roller 80 supported thereon relative to the stack support surface 22 in the tray 20 when a stack of sheets is to be inserted against the stack stop 250. The follower 260 also has a second cam surface 268 which engages the leg 256 on the stack stop link 252 for raising and lowering the stack stop into and out of sheet blocking position. A third cam surface 270 (FIG. 16C) on the follower 260 is provided for engagement with the bogie tail lever arm 56 and is used for test purposes not relevant herein when the single sheet feeder module is not installed on the document processing module. The follower 260 also includes an axially protruding portion in the form of a pin 272 for a purpose to be described.

The modular roller support and drive assembly 200 also includes a swing arm 280 axially supported on the shaft 201 for rotation relative to the shaft 201 by spaced swing arm supports 284, 286. A power input gear assembly 290 having axially spaced gears 291 affixed to opposite ends of a sleeve 292 is mounted on the support shaft 201. One of the axially spaced gears 291 receives input power from an automatic direction finding gear drive (not shown) driven by the motor 35. The other of the axially spaced gears 291 on the input gear assembly 290 is continuously engaged with a clutch gear 294 supported on the swing arm 280. A drag spring 295 for the clutch gear 294 is also provided. A pocket 296 seen in FIG. 16(3) in the side face of the swing arm 280 receives the pin 272 on the follower so that rotation of the swing arm on shaft 201 lifts the follower 260 when the input gear assembly 290 is rotated in the reverse direction of rotation by the motor 35. A motion limit hook 300 is also integrally formed on the swing arm 280 for engagement with the protruding end of the separation roller axle 92 to provide over-engagement protection between the teeth of the main clutch gear 294 and the separation roller drive gear 98 and to restrain lifting of the bogie frame 50.

A rotary cam Geneva 310 is also affixed to the input gear assembly 290 and is positioned on the remote side of the swing arm 280 from the gears 291 and in alignment with the follower 260 so that the point 264 on the follower engages a cylindrical surface of the cam and is permitted to enter an aperture 312 in the form of a slot 312 in the cylindrical surface of the cam 310 when the cam rotates in the forward or counterclockwise direction as seen in FIG. 16(1). Reverse rotation of the input gear assembly 290 causes the cam 310 to lift the point 264 from the slot aperture 312 to raise the bogie and lower the stack stop 250 for insertion of a new stack of media sheets.

Figure 10:
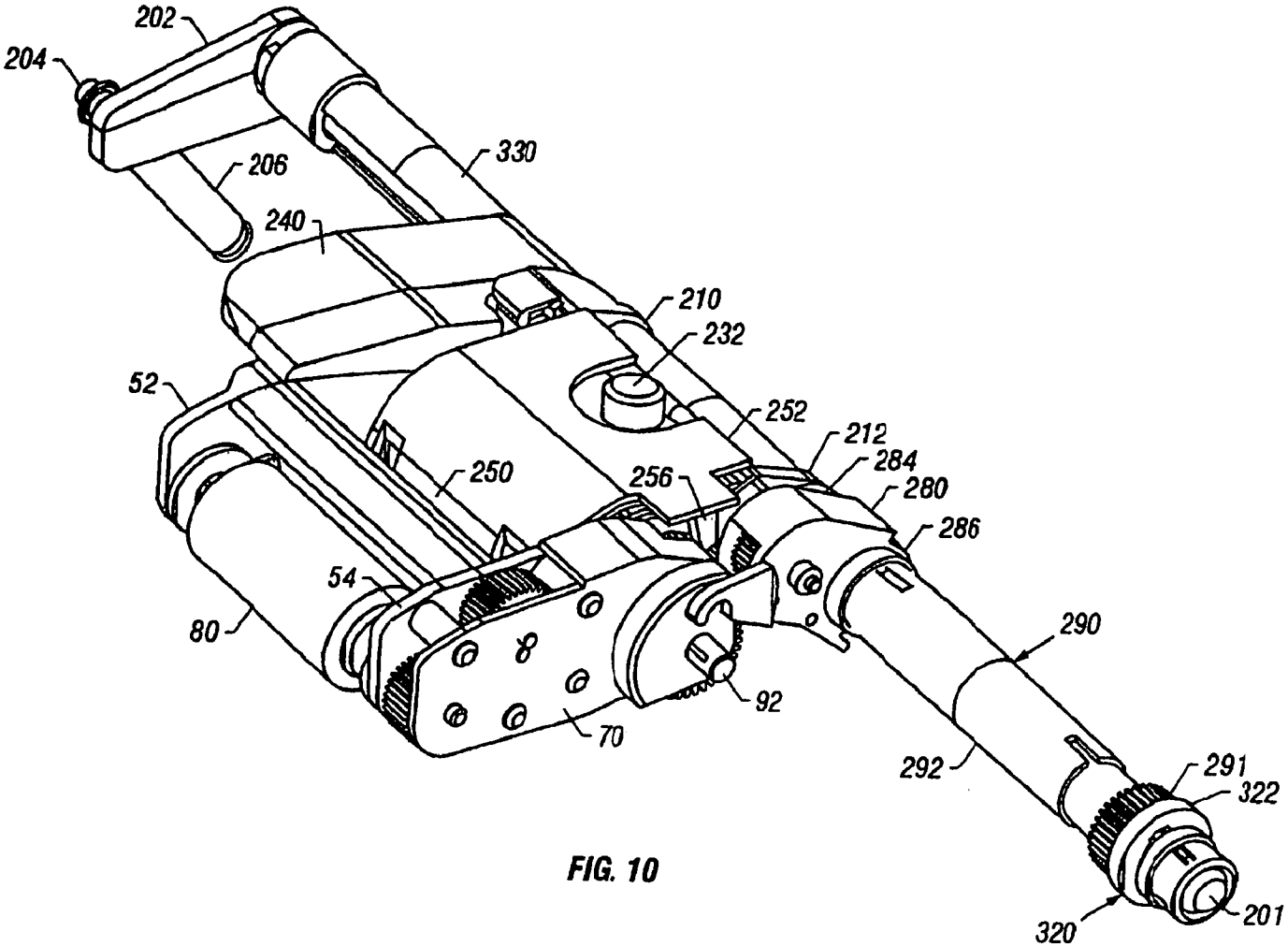
FIG. 10 is a perspective view of the modular roller support assembly.
Figure 11:
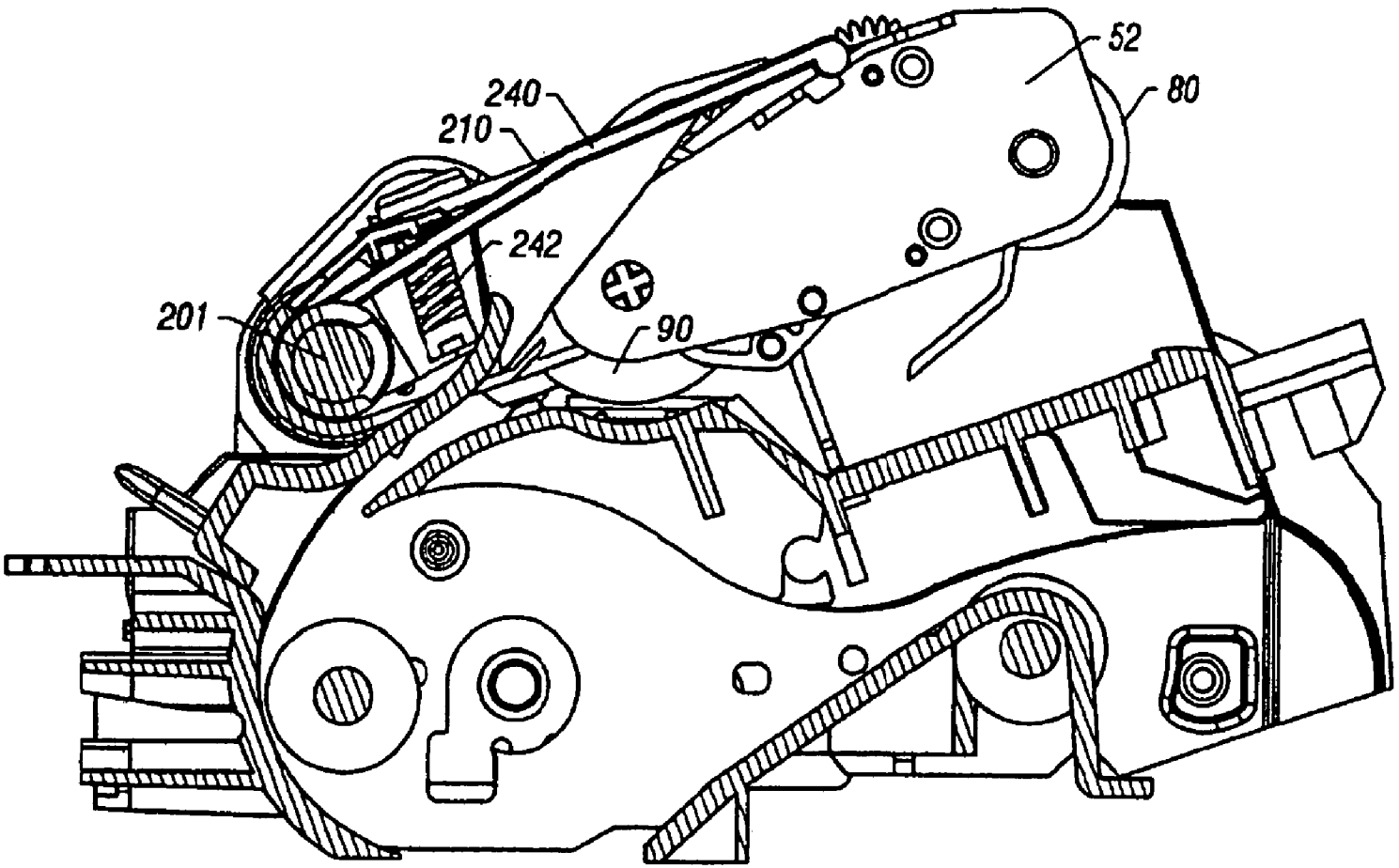
FIG. 11 is a cross sectional elevation of the modular roller support assembly taken at line 11-11 on FIG. 9 showing the bogie lifting handle.
Figure 12:
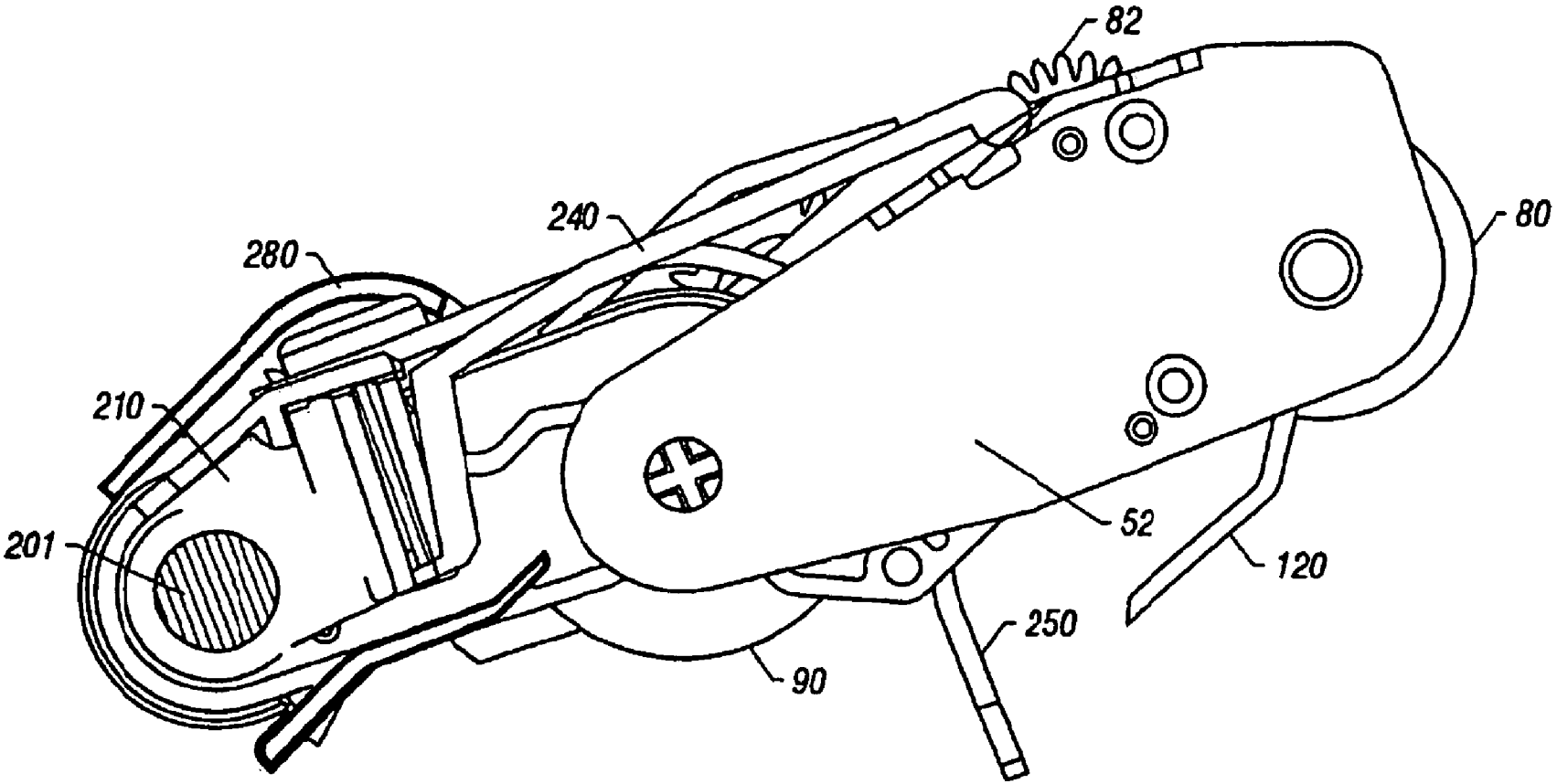
FIG. 12 is a cross sectional elevation taken at line 12-12 on FIG. 9 showing a bogie support load arm.
Figure 13:
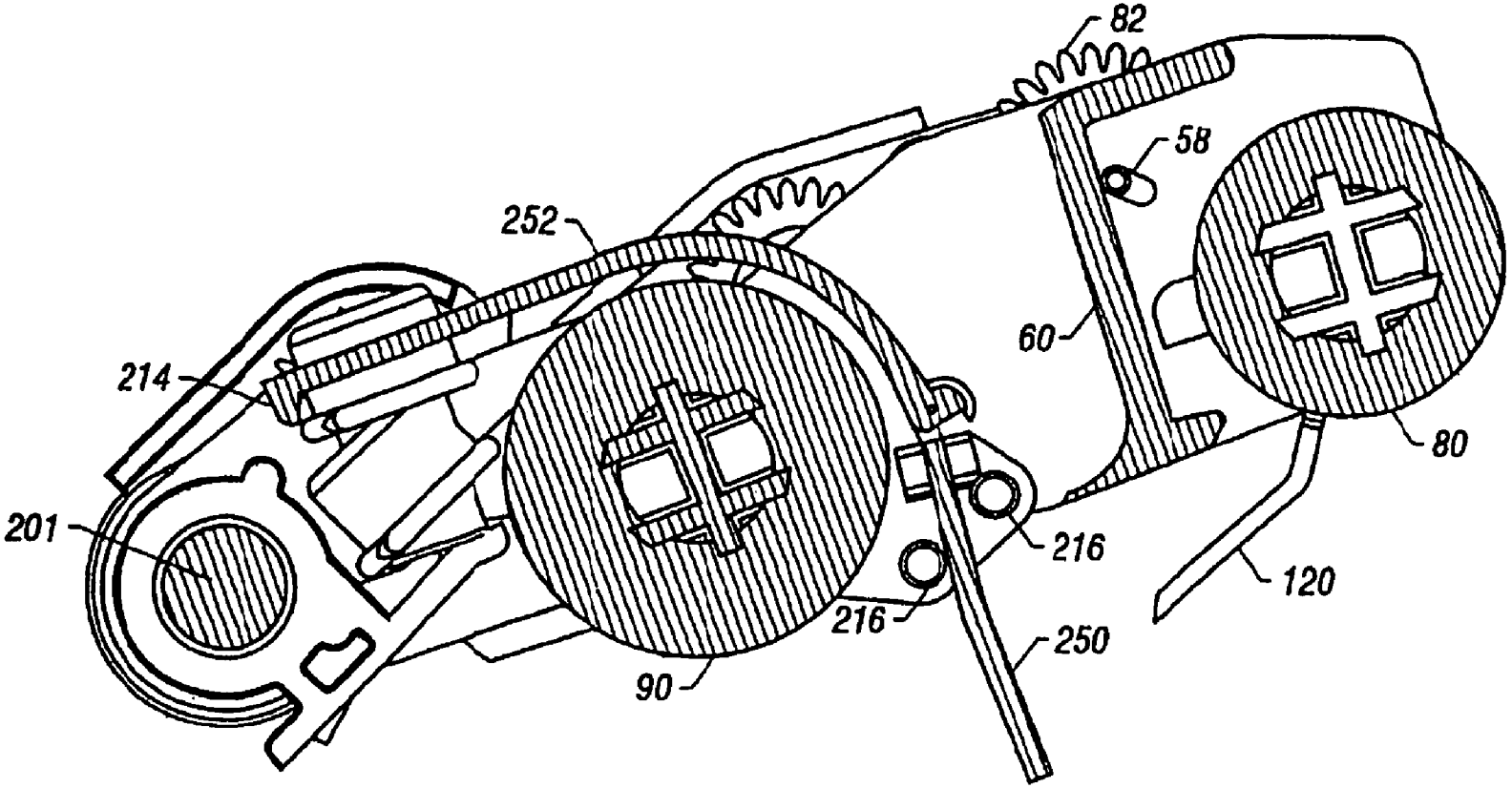
FIG. 13 is a cross sectional elevation taken at line 13-13 on FIG. 9 showing the bogie latch and the stack stop.
Figure 14:
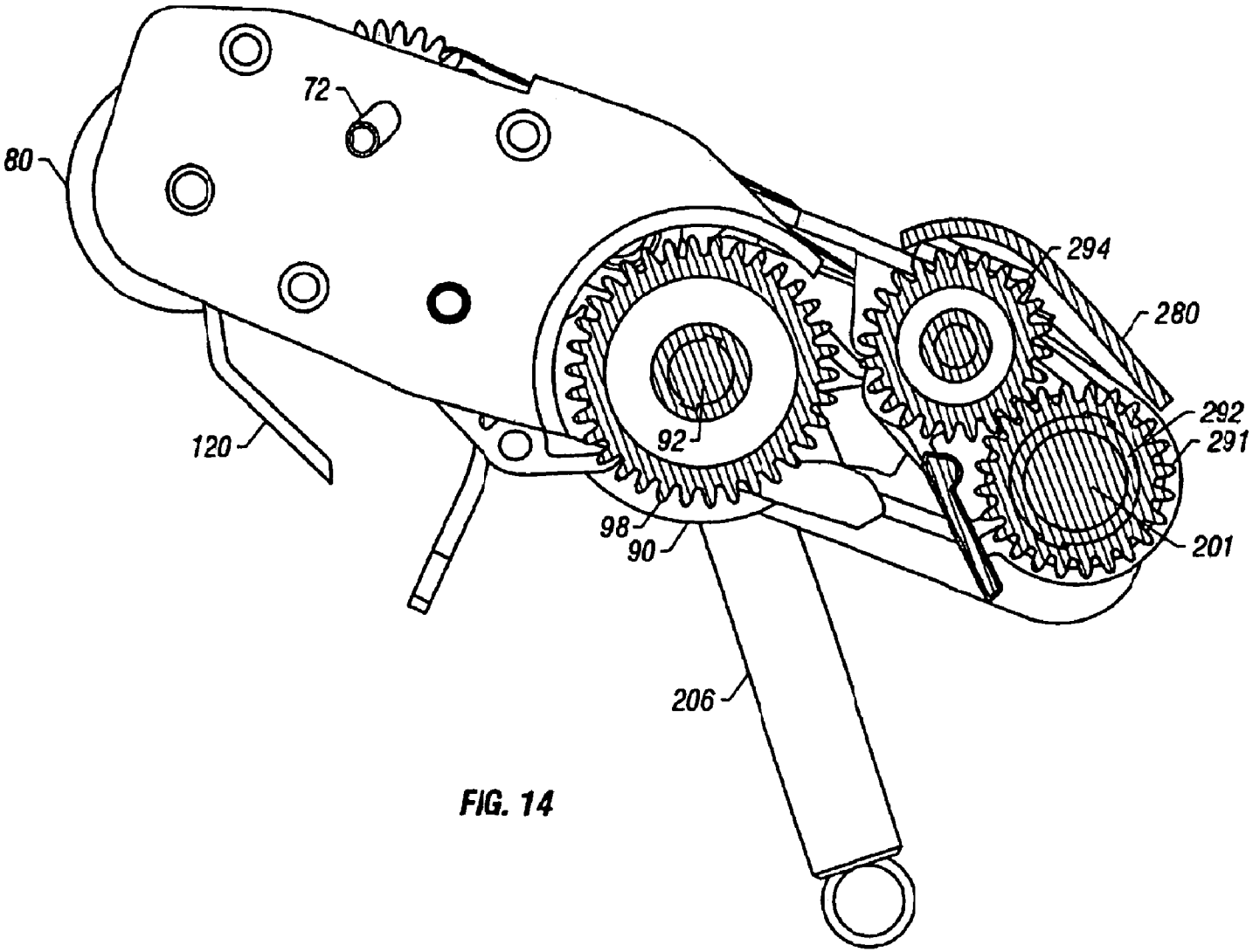
FIG. 14 is a cross sectional elevation taken at line 14-14 on FIG. 9 showing the main clutch gear disengaged from the separation roller drive gear.
Figure 15:
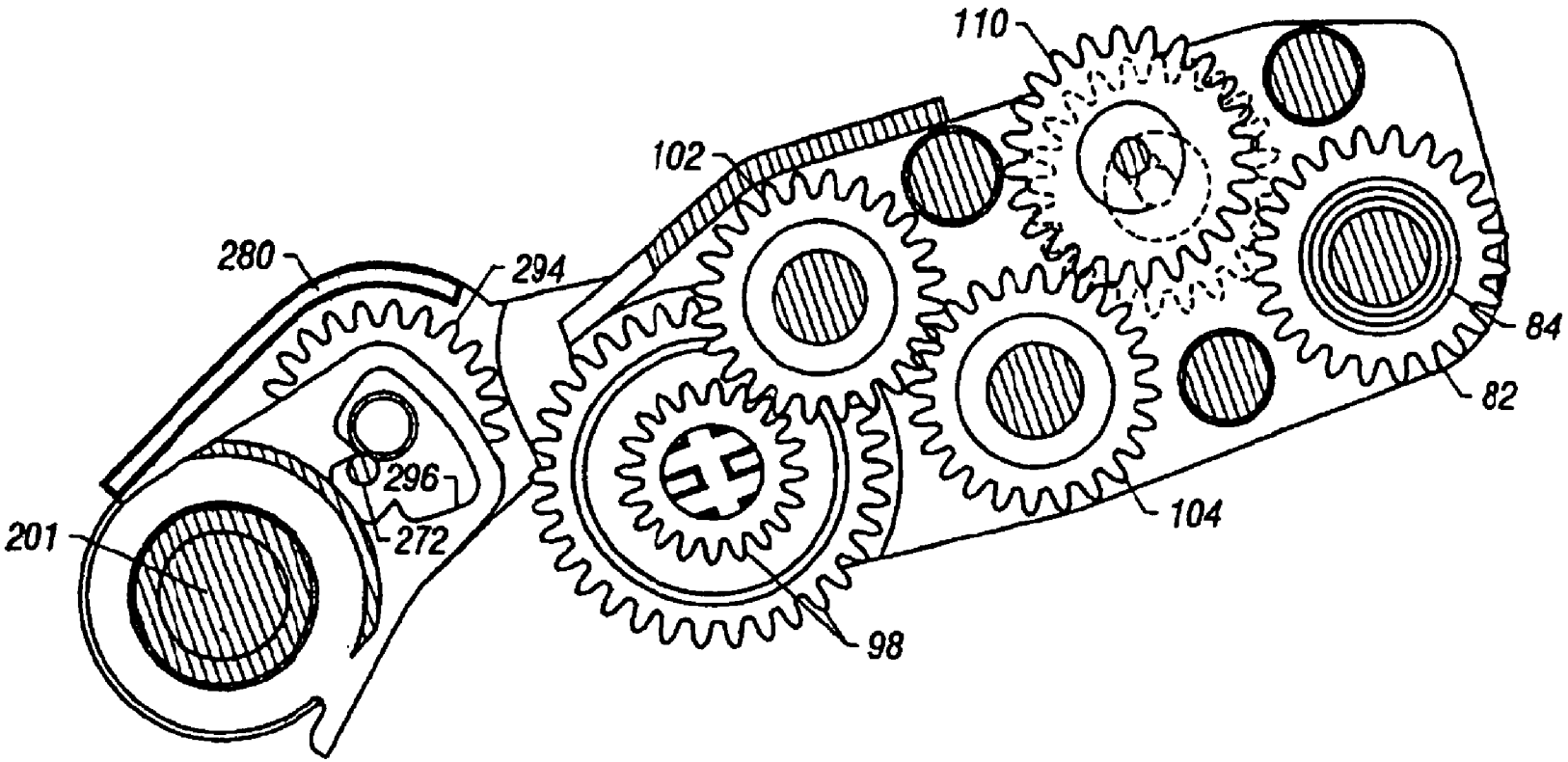
FIG. 15 is a cross sectional elevation taken at line 15-15 on FIG. 9 showing the follower engagement with the swing arm.

The swing arm 280 and input gear assembly 290 including the cam Geneva 310 which are all rotatably supported on the shaft 201 are retained on the shaft by a retainer 320 suitably affixed to the shaft to axially position one of the input gears 291 in alignment with the motor output gear (not shown) and the other gear 291 is positioned for engaging the clutch gear 294 supported on the swing arm 280. As seen in FIG. 10, the retainer 320 has an arcuate, preferably cylindrical, surface 322 adjacent to the input gear 291 in a position such that the cylindrical surface 322 will be engaged by a motor output gear support which moves the motor output gear (not shown) into and out of engagement with the input gear 291 and thus prevents over engagement of the motor output gear and the input gear 291. The retainer 320 may be held in position on the shaft 201 by a snap spring seated in a properly axially positioned circumferential groove on the shaft 201 or by any other suitable means. A split sleeve 330 made of resilient plastic is snapped onto the other end of the shaft 201 adjacent the bogie lifting handle 240 to provide proper positioning of the lifting handle 240.

Operation

A stack of media sheets is inserted into the sheet feeder beneath the pre-feed roller 80 which is initially positioned at a distance above the stack support surface 22 to permit stack insertion until the leading edge of the stack engages the stack stop 250. Application of input power in the forward direction to the input gear assembly 290 then rotates the Geneva cam 310 and aperture 312 to a position which permits the follower finger 264 to drop into the cam aperture 312. Continued forward rotation of the motor then lifts the stack stop 250 and drops the bogie and roller 80 into sheet transporting position. The pre-feed roller 80 is under driven relative to the separation roller 90 which subsequently is under driven with respect to the sheet moving rollers in the document processing module (not shown) such that sheets are pulled through the feeder. In addition, both the pre-feed roller 80 and the separation roller 90 are clutch driven to allow them to be over driven by the media sheet. The pre-feed roller drag spring 84 places drag on the pre-feed roller drive gear to permit dwell to be built up in the pre-feed roller 80. The pre-feed roller 80 is under driven so that dwell can be accumulated during advancement of the sheet of media, the dwell then being consumed after the trailing edge of one sheet leaves the pre-feed roller 80. This dwell then allows the pre-feed roller to remain stationary so that a second sheet will also remain stationary until the trailing edge of the first sheet has just left the nip defined between the separation roller 90 and the tray 20.

Since the separation roller 90 must be under driven relative to the downstream document processing rollers (not shown) the separation roller 90 needs to be clutched in an overdrive situation to prevent abnormally high back tension from the sheet feeder module and unnecessary parasitic torque losses in the drive system caused by a sheet of paper pulled by the downstream document processing module rollers. The clutch gear 294 for the separation roller 90 therefore needs to engage when the bogie is in the down position. Also, the stack stop 250 must be in the up position whenever the rollers 80, 90 are driven to transport a sheet of media. Conversely, the clutch gear 294 for the separation roller 90 is disengaged when the bogie is up, the stack stop is down, and the system is dormant. The separation roller clutch gear 294 also allows the separation roller to free wheel when the sheet is being pulled down downstream by the document processing module rollers.

Figures 1, 16A:
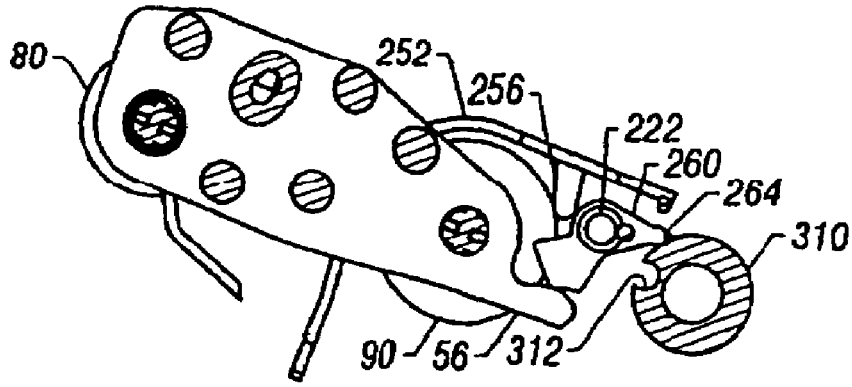
FIGS. 16A-16E show five positions of the bogie and stack stop as controlled by different positions of a cam follower moved by a cam and by a swing arm.
Figures 2, 16A:
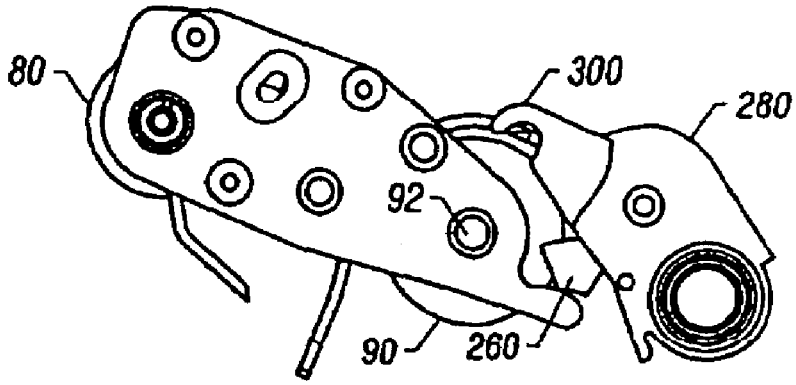
Figures 3, 16A:
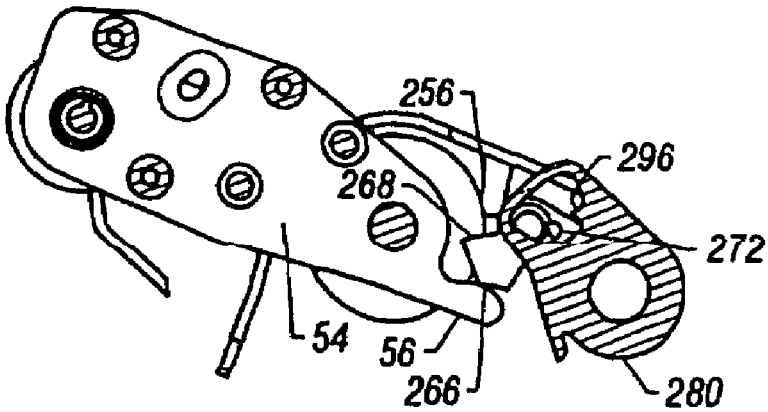

The follower finger 264 is always urged against the cylindrical surface of the Geneva cam 310 due to bias by the tail lever arm 56 on the bogie frame 50 on the cam surface 266 of the follower 260. Although a compression spring 242 engaged with the lifting arm provides this bias, various alternatives can easily be envisioned by those skilled in the art. The point on the end of finger 264 is therefore urged into the aperture 312 whenever the aperture rotationally passes in the forward direction past the finger 264 but the aperture in the cam 310 is curved to prevent entry of the point into the aperture when the cam 310 continues to rotate in the same direction after the finger 264 has exited the aperture 312. This provides four stable operational positions of the follower:

1. Stack Insertion or Up-Up—The pre-feed roller 80 is spaced from the input tray and the follower 260 and protruding pin 272 are in the up position and the point 264 engages the cylindrical surface of the cam 310 anticipating passage of the slot as seen in FIG. 16A(1). The follower 260 is upwardly biased by the bogie tail lever arm 56. The coefficient of friction between the engaged surfaces of the follower and lever arm must be low enough to ensure that the lever arm urges the follower point 264 toward the surface of the cam 310. The swing arm 280 is also in the up position as seen in FIGS. 16A(2 and 3) and a lower wall of swing arm pocket 296 is engaged with the pin 272.

Figures 1, 16B:
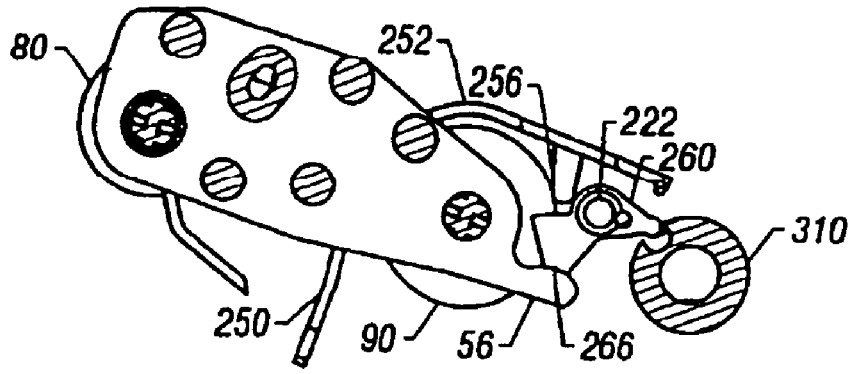
Figures 2, 16B:
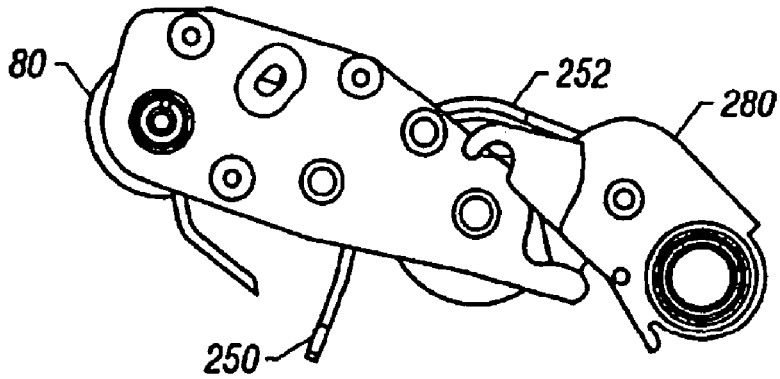
Figures 3, 16B:
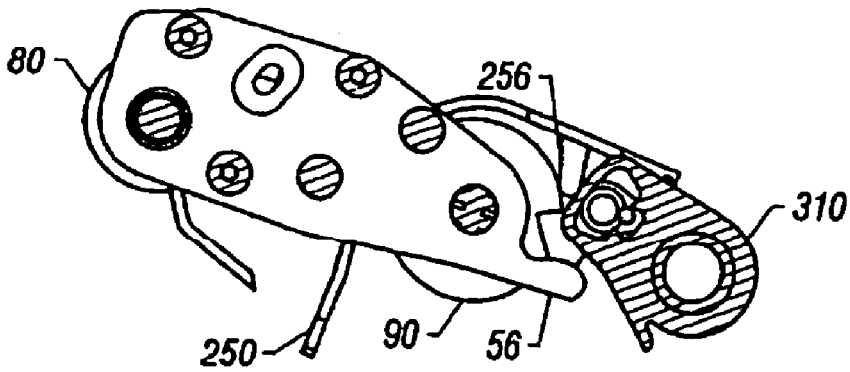
Figures 1, 16C:
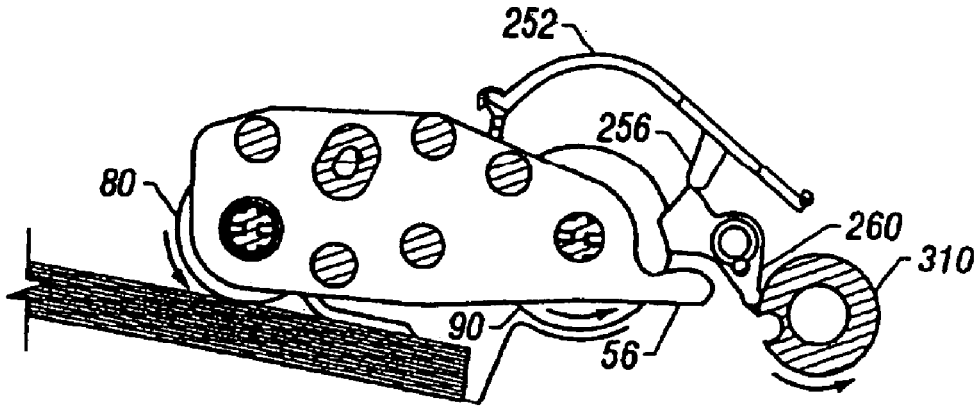
Figures 2, 16C:
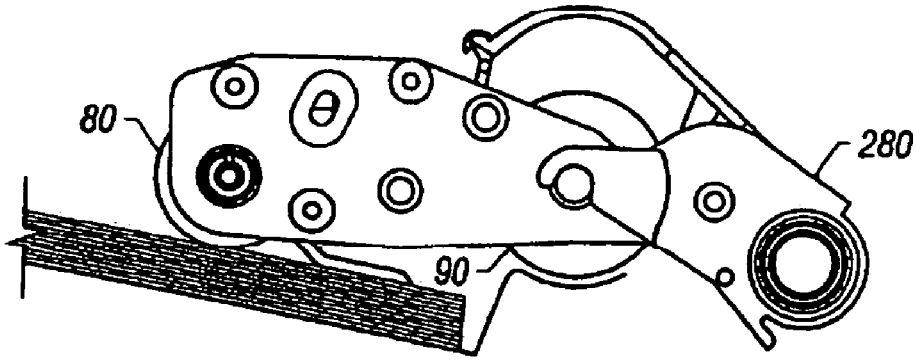
Figures 3, 16C:
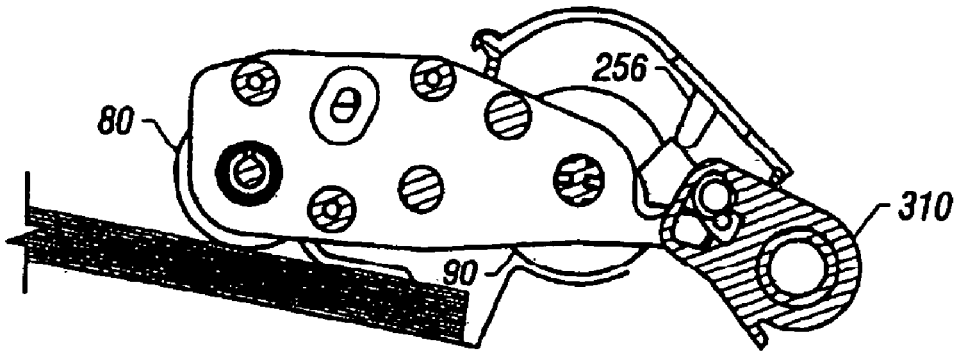

2. Up-Down—The pre-feed roller 80 is still spaced from the input tray since the follower 260 is in the up position but the point 264 has moved into the aperture 312 as seen in FIG. 16B(1). It is to be noted that the point 264 enters the aperture 312 only when the cam is rotated in the reverse direction (counterclockwise as seen in FIG. 16). The first cam surface 266 on the follower allows the follower to maintain in a stable up-down state without jumping to one of the following positions. The swing arm 280 has commenced downward movement as seen in FIGS. 16B(2 and 3) and an upper wall of the pocket 296 now engages the pin 272.

3. Operational State—This position seen in FIGS. 16C(1-3) is used to pre-feed a document from the input stack and present it to the separation nip and then drive the sheet to the scanning region of the apparatus. The pre-feed roller 80 rests on top of the input stack of media and is downwardly biased with sufficient sheet picking force by the handle 240. The follower and stack stop are in the same position as in the down states but there is clearance between the follower surface 270 and the tail lever arm 56. This allows all of the force from the lifting handle 240 to load the pre-feed roller against the input stack. The swing arm is down and engaged and the bogie clutch gear is engaged. Rotational power input then rotates the rollers 80, 90 in the forward direction.

Figures 1, 16D:
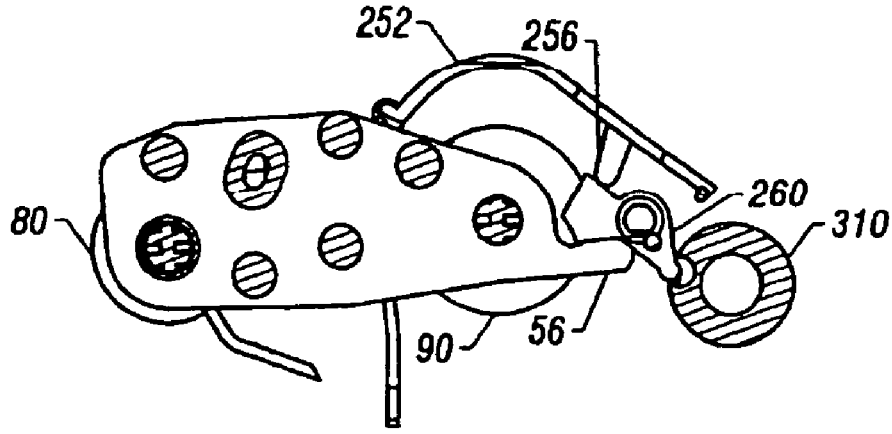
Figures 2, 16D:
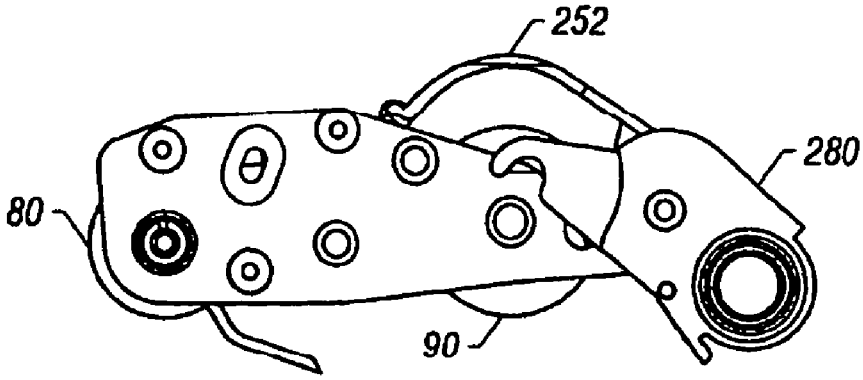
Figures 3, 16D:
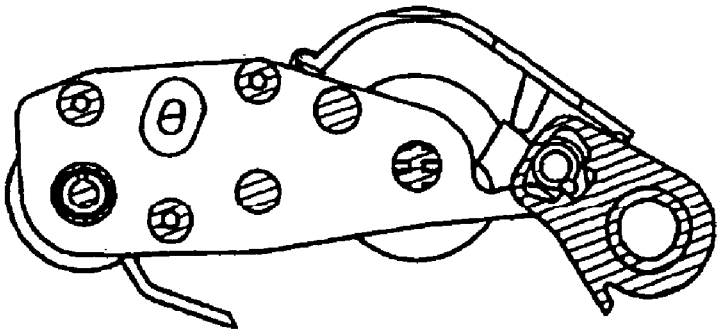

4. Down-Up—This position is used when testing the modular roller support and drive assembly 200. The pre-feed roller 80 is in the down position as cam 310 is rotated in the reverse direction and the follower point 264 has entered the aperture 312 in the cam 310 due to engagement of the tail lever arm 56 with the first cam surface 266 of the follower pushing the point up into the aperture 312 as seen in FIG. 16D(1). The swing arm 280 is in the up and disengaged position as seen in FIGS. 16D(2 and 3) when the input is rotating in the reverse (clockwise) direction. There is enough space in the pocket 296 to allow the swing arm to rotate down into the engaged position if the input power is applied in the forward (counterclockwise) direction.

Figures 1, 16E:
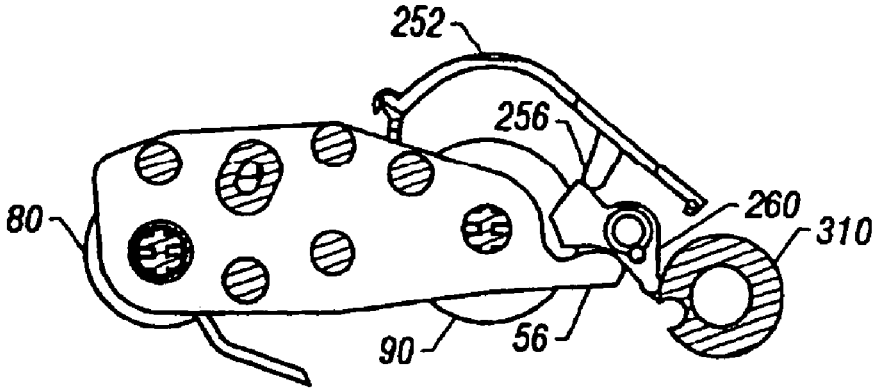
Figures 2, 16E:
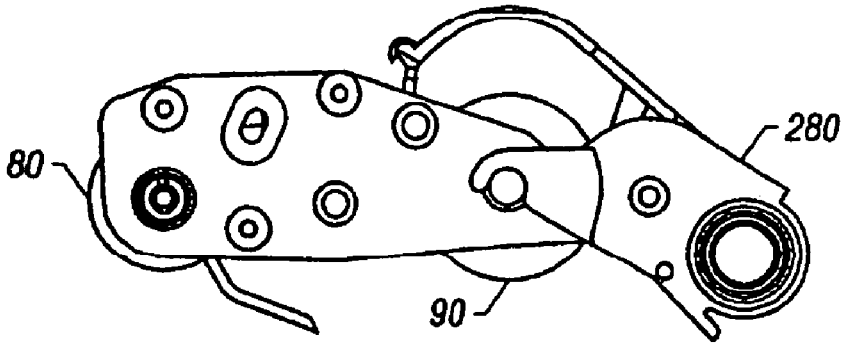
Figures 3, 16E:
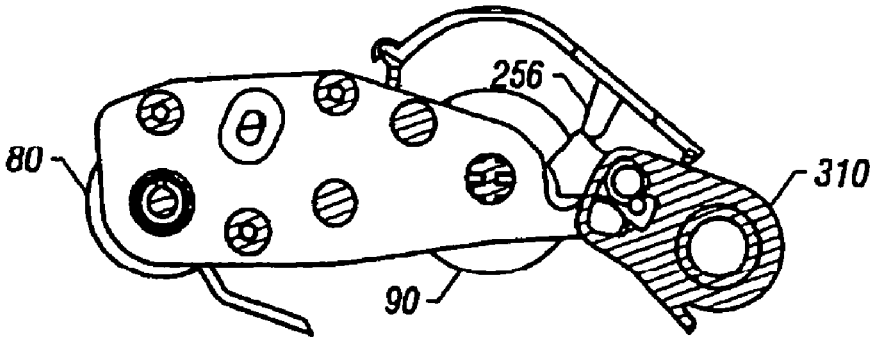

5. Down-Down—The pre-feed roller 80 and follower 260 are down and the point 264 is ready to enter the aperture 312 in the cam Geneva as seen in FIG. 16E(1). The swing arm 280 is also in the down position as seen in FIGS. 16E(2 and 3).

The second cam surface 268 on the follower engages the leg 256 of the stack stop link 252 to raise the stack stop 250 when the follower rotates to the down position seen in FIGS. 16D and E. When the follower 260 rotates to the up position, the stack stop link and stack stop are lowered as seen in FIGS. 16A and B.

Engagement of the follower pin 272 by the walls of the swing arm pocket 296 ensures that when the follower 260 is in the up position the bogie is also up and the stack stop 250 is in the down position and the main clutch gear 294 on the swing arm is not engaged with the separation roller drive gear 98. Thus, the system is in "neutral" so that the input gear assembly 290 can rotate indefinitely in the reverse direction without engagement of the drive train for the rollers 80, 90.

The drag spring 295 for the main clutch gear 294 gives the clutch gear a propensity to engage when rotating in the forward direction and the motion and the impetus to disengage when the clutch gear rotates in the reverse direction. This impetus is transferred to the pin 272 on the follower by the surfaces of the pocket 296 on the swing arm. There is adequate spacing between the pocket surfaces such that some over travel of the swing arm 280 is permitted for the overrunning clutching purposes previously explained. The surfaces of the pocket 296 are angled such that they rotate the follower about its pivotal support post 246 with the maximum amount of engagement of the point 264 with the Geneva cam 310.

The stack damper 120 on the bogie frame 50 is preferably made of plastic and has a weight heavy enough to constrain thin media sheets driven by pre-feed roller 80 to prevent buckling in the area between the pre-feed roller 80 and the separation roller 90, yet light enough to prevent it from buckling between the pre-feed roller 80 and stack damper 120. The stack damper 120 is also stopped in its upward travel to impart a slight bend to thick media sheets during sheet movement imparted by the pre-feed roller 80. The stack damper 120 falls after each sheet passes to beat down subsequent sheets of media that may be climbing up the inclined retard wall 36 reducing the tendency for more than just a few sheets to thereafter be driven over the top of the wall 36. The stack damper 120 rests by gravity on top of the top sheet of media. The bottom surface of the stack damper 120 is tangential to the outer drive surface of the pre-feed roller 80 to ensure that the surface of the stack damper is always in flat contact with the top sheet of the input stack regardless of the height of the input stack. The physical engagement of the stack damper 120 with a very stiff sheet to slightly bend it thus prevents it from moving straight from the input stack over the crest of the retard wall 36, scrubs off additional sheets from climbing over the top edge of the retard wall 36 and initiates proper form to a stiff sheet by providing a bend orthogonal to the direction of movement of the sheet. This eliminates sheet curl and other discontinuities that may exist in an axis parallel with the direction of movement of the sheet that can disturb single sheet separation.

The modular roller support and drive assembly 200 can easily be assembled to and removed from the tray 20 by detaching the spring 206. The support shaft 201 can then be rotated to the proper position so that it can be removed from its supports in the side walls of the tray 20. The mounting of the entire roller support and drive assembly 200 on a single support shaft 201 enables accurate alignment, loading and positioning of the various structural pieces mounted on the shaft.

The pre-feed roller clutch gear 110 is preferably made of elastomeric material or has elastomeric teeth thereon for quiet operation. The clutch gear 110 is supported on an axle received in slots 58, 72, the bottom saddle of which prevents over engagement of the clutch gear with the pre-feed roller drive gear 82. When the pre-feed roller 80 is over driven, the clutch gear 110 moves upwardly until its teeth disengage from the pre-feed roller drive gear 82. The slots are angled or preferably arcuate such that the clutch gear never disengages from the intermediate drive gear with which it is engaged. The use of elastomeric teeth on the clutch gear 110 has been found to significantly reduce objectionable clicking noises created when clutching gears made out of hard plastic materials are moved into engagement with the driven gear.

Persons skilled in the art will also appreciate that various additional modifications can be made in the embodiment shown and described above and that the scope of protection is limited only by the wording of the claims which follow.

What is claimed:

1. A sheet transfer apparatus comprising:

a first roller configured to be rotatably driven at a first surface speed;

a second roller spaced from the first roller such that the first roller and the second roller are configured to simultaneously engage a media sheet, wherein the second roller is configured to be driven at a second surface speed greater than the first surface speed; and a power train delivering power to the first roller to rotatably drive the first roller, the power train including:

a first gear coupled to the first roller;

a second gear; and a third gear movable between a first position in which the third gear is in power-transmitting engagement with the first gear and the second gear and a second position in which the third gear is out of engagement with the first gear, wherein the third gear has teeth inter-meshed with teeth of the first gear and the second gear in the first position.

2. The apparatus of claim 1, wherein the first gear and the first roller are configured such that a dwell between the first gear and the first roller is created upon the first roller and the second roller simultaneously engaging the media sheet.

3. The apparatus of claim 1, wherein the third gear remains in the first position upon the first roller and the second roller simultaneously engaging the media sheet.

4. The apparatus of claim 1 including a drag spring coupled between the first roller and the first gear.

5. The apparatus of claim 1, wherein the first roller is a pre-feed roller and wherein the second roller is a separation roller.

6. The apparatus of claim 1, wherein the third gear includes elastomeric teeth.

7. The apparatus of claim 1 including a frame rotatably supporting the first roller and the second roller.

8. The apparatus of claim 1, wherein the power train extends between the first roller and the second roller.

9. The apparatus of claim 1 including a frame having a slot, wherein the third gear moves along the slot between the first position and the second position.

10. The apparatus of claim 1, wherein the sheet transfer apparatus is configured for use with a document processing apparatus configured to perform at least one of printing, scanning, faxing or copying and wherein the first roller and the second roller are configured to engage the media sheet prior to the media sheet being printed upon, scanned, faxed or copied by the document processing apparatus.

11. The apparatus of claim 1, wherein the power train is configured to remain operably coupled to the second roller to rotatably drive the second roller when the third gear is in the second position.

12. The apparatus of claim 1, wherein the power train is configured such that simultaneous engagement of the media sheet by the first roller and the second roller drives the third gear to the second position.

13. The apparatus of claim 2, wherein the third gear is in the first position as the dwell is being created.

14. The apparatus of claim 3, wherein the first roller is configured to rotate relative to the first gear upon the first roller and the second roller simultaneously engaging the media sheet.

15. The apparatus of claim 7, wherein the power train includes a fourth gear coupled to the second roller and a fifth gear coupled between the fourth gear and the second gear.

16. The apparatus of claim 14, wherein the first roller includes a first dwell mechanism surface and a second dwell mechanism surface, wherein the first gear includes a third dwell mechanism surface and a fourth dwell mechanism surface, wherein the third dwell mechanism surface engages the first dwell mechanism surface to drive the first roller and wherein the second dwell mechanism surface engages the fourth dwell mechanism surface to drive the first gear to move the third gear from the first position to the second position.

17. The apparatus of claim 13, wherein the first gear moves the third gear to the second position upon a maximum dwell being attained.

18. The apparatus of claim 16, wherein the first dwell mechanism surface is configured to disengage the third dwell mechanism surface upon the first roller and the second roller simultaneously engaging the media sheet in response to the first dwell mechanism surface being rotatably driven at a first rate and the third dwell mechanism surface being rotatably driven at a second slower rate.

19. A sheet transfer apparatus comprising:

a first roller configured to be rotatably driven at a first surface speed;

a second roller spaced from the first roller such that the first roller and the second roller are configured to simultaneously engage a media sheet, the second roller being configured to be driven at a second surface speed greater than the first surface speed;

a power train configured to deliver power to the first roller to rotatably drive the first roller, the power train including:

a first gear;

a second gear; and a third gear movable between a first position in which the third gear is in power transmitting engagement with the first gear and the second gear and a second position in which the third gear is out of engagement with the first gear; and a dwell mechanism between the first roller and the first gear, wherein the dwell mechanism is configured to operably couple the first gear to the first roller to drive the first roller when the first roller and the second roller are not simultaneously engaging the media sheet, to enable the fist roller to rotate relative to the first gear to create dwell when the first roller and the second roller simultaneously engage the media sheet and to couple the first roller to the first gear such that the first roller drives the first gear to move the third gear to the second position when a maximum dwell has been reached and while the first roller and the second roller simultaneously engage the media sheet.

20. The apparatus of claim 19 wherein the dwell mechanism includes:

a first surface and a second surface coupled to the first roller; and a third surface and a fourth surface coupled to the first gear, wherein the third dwell mechanism surface engages the first dwell mechanism surface when the third gear is in the first position and when the first roller and the second roller are not simultaneously engaging the media sheet, wherein the first dwell mechanism surface disengages the third dwell mechanism surface when the first roller and the second roller simultaneously engage the media sheet to create a dwell and wherein the second dwell mechanism surface engages the fourth dwell mechanism surface to drive the first gear and to move the third gear to the second position when a maximum dwell is reached and while the first roller and the second roller simultaneously engage the media sheet.

21. The apparatus of claim 19 including a drag spring coupled between the first roller and the first gear.

22. The apparatus of claim 19, wherein the first roller is a pre-feed roller and wherein the second roller is a separation roller.

23. The apparatus of claim 19, wherein the third gear includes elastomeric teeth.

24. The apparatus of claim 19 including a frame rotatably supporting the first roller and the second roller.

25. The apparatus of claim 19, wherein the power train extends between the first roller and the second roller.

26. The apparatus of claim 19 including a frame having a slot, wherein the third gear moves along the slot between the first position and the second position.

27. The apparatus of claim 24, wherein the power train includes a fourth gear coupled to the second roller and a fifth gear coupled between the fourth gear and the second gear.

28. A sheet transfer apparatus comprising:

a first roller configured to be rotatably driven at a first surface speed;

a second roller spaced from the first roller such that the first roller and the second roller are configured to simultaneously engage a media sheet, the second roller being configured to be driven at a second surface speed greater than the first surface speed;

a drive gear operably coupled to the first roller; and means for cessating transmission of power to the drive gear and rotationally driving the second roller while creating a dwell after the first roller and the second roller have initially and simultaneously engaged a media sheet; and means for consuming the dwell automatically in response to disengagement of the media sheet from the first roller and while rotationally driving the second roller.

29. The apparatus of claim 28, wherein the sheet transfer apparatus is configured for use with a document processing apparatus configured to perform at least one of printing, scanning, faxing or copying and wherein the first roller and the second roller are configured to engage the media sheet prior to the media sheet being printed upon, scanned, faxed or copied by the document processing apparatus.

30. A sheet transfer apparatus comprising:

a first roller configured to be rotatably driven at a first surface speed;

a second roller spaced from the first roller such that the first roller and the second roller are configured to simultaneously engage a media sheet, wherein the second roller is configured to be driven at a second surface speed greater than the first surface speed; and a power train delivering power to the first roller to rotatably drive the first roller, the power train including:

a first gear coupled to the first roller;

a second gear;

a third gear movable between a first position in which the third gear is in power-transmitting engagement with the first gear and the second gear and a second position in which the third gear is out of engagement with the first gear; and a frame having a slot, wherein the third gear moves along the slot between the first position and the second position.

* * * * *

UNITED STATES PATENT AND TRADEMARK OFFICE

CERTIFICATE OF CORRECTION

PATENT NO. : 7,431,284 B2
APPLICATION NO. : 10/775411
DATED : October 7, 2008
INVENTOR(S) : Glenn Gaarder et al.

It is certified that error appears in the above-identified patent and that said Letters Patent is hereby corrected as shown below:

In column 10, line 60, in Claim 19, delete “fist” and insert -- first --, therefor.

Signed and Sealed this

Twenty-fourth Day of February, 2009

JOHN DOLL
*Acting Director of the United States Patent and Trademark Office*